United States Patent [19]

Aberl et al.

[11] Patent Number: 5,028,258

[45] Date of Patent: Jul. 2, 1991

[54] PROCESS OF CONTROLLING THE SLAG IN A TOP-BLOWING STEELMAKING CONVERTER

[75] Inventors: Heinrich Aberl, Linz; Alois Schmitzberger, Meggenhofen, both of Austria

[73] Assignee: Voest-Alpine Industrieanlagenbau Gesellschaft m.b.H., Linz, Austria

[21] Appl. No.: 530,018

[22] Filed: May 25, 1990

[30] Foreign Application Priority Data

Jun. 5, 1989 [AT] Austria ..... 1359/89

[51] Int. Cl.[5] ..... C21C 5/32

[52] U.S. Cl. ..... 75/386; 75/375; 75/548

[58] Field of Search ..... 75/528, 548, 375, 386; 266/78, 80, 99

[56] References Cited

U.S. PATENT DOCUMENTS 4,345,746 8/1982 Schleimer et al. ..... 266/78

4,398,948 8/1983 Emoto et al. ..... 75/375

*Primary Examiner*—S. Kastler

*Attorney, Agent, or Firm*—Kurt Kelman

[57] ABSTRACT

In the operation of a top-blowing steelmaking converter having at least one blowing lance, the distance of said lance from the surface of the molten metal bath is controlled in dependence on the sound levels of the blowing noise measured through the slag at selected frequencies. In order to minimize the risk of slopping, the actual values of the sound levels measured at predetermined frequencies are combined to form a resultant value, the difference between said resultant value and a predetermined reference value, which is associated with a sound level and indicates that slopping is likely to occur, is determined, and said difference is used as an indication of the probability of an occurrence of slopping and is compared with at least one predetermined probability limit, the distance of the blowing lance and optionally also the oxygen supply rate is corrected when said difference exceeds said probability limit.

10 Claims, 1 Drawing Sheet

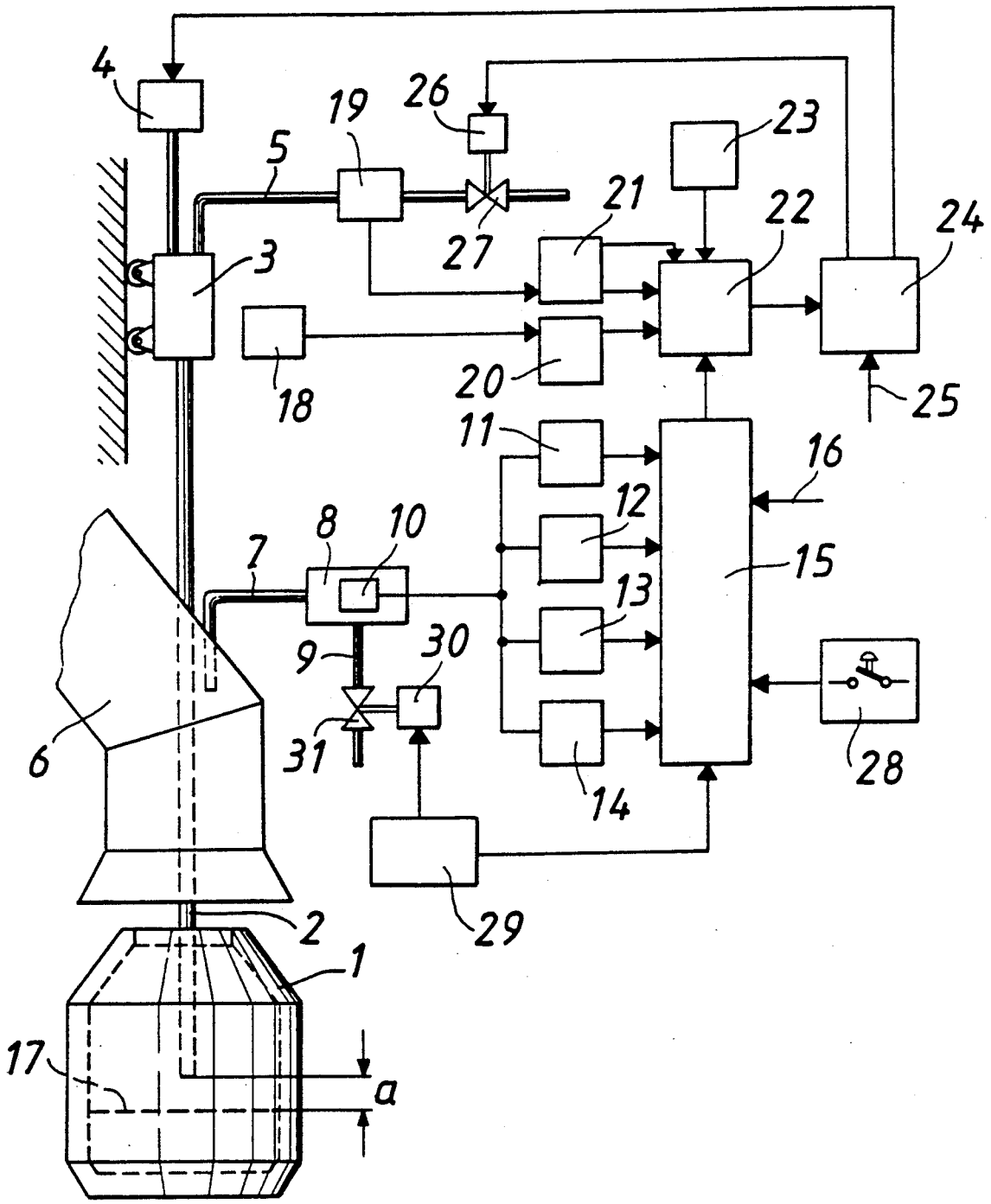
4
19
26
23
5
21
22
24
3
27
18
20
25
11
16
12
8
10
7
15
13
9
30
31
28
6
14
29
2
1
17
a

PROCESS OF CONTROLLING THE SLAG IN A TOP-BLOWING STEELMAKING CONVERTER

BACKGROUND OF THE INVENTION

1. Field of the Invention

This invention relates to a process of controlling the slag in a top-blowing steelmaking converter comprising at least one blowing lance, which is spaced above the surface of the bath at a distance therefrom which is controlled to ensure a desired progress of the refining process, wherein said distance is adjusted in dependence on the sound level which is due to the blowing noise and is measured through the slag layer at selected frequencies and the oxygen supply rate is optionally adapted.

2. Description of the Prior Art

In a top-blowing steelmaking converter the refining progress depends mainly on slag reactions. For this reason the formation and maintenance of a foamy, reactive slag, the control of the distance of the blowing lance from the surface of the molten bath, which distance has a significant influence on the slag control, and the control of the rate at which oxygen is supplied through the blowing lance are of high significance. At the beginning of the blowing operation a relatively high oxidation of iron and a low oxidation of carbon are desired in order to effect a dissolution of the lime which has been added. An increasing decarburization must be effected as the blowing operation proceeds and a proper decarburization rate must be maintained in order to ensure a desirable slag level and to avoid a slopping. For this reason the distance of the lance from the surface of the molten bath is decreased as the slag level rises after the beginning of the blowing operation. Because the slag which has formed will damp the blowing noise, the sound level which has been measured through the slag can be utilized for a control of the slag, particularly because the sound level of the blowing noise which is damped by the slag, which sound level may be measured at predetermined frequencies, will also depend on the composition of the slag. For this reason the sound level of the blowing noise which is damped by the slag and is measured at defined frequencies can be used for a control of the distance of the lance from the surface of the molten bath in such a manner that a proper reactive fluid slag will be obtained in each stage of the blowing process. But the state of the slag will be influenced by numerous variables and constantly changes. For this reason a control of the lance only in dependence on the sound level of the blowing noise which is damped by the slag is not sufficient for ensuring that slopping will be prevented, as is required.

SUMMARY OF THE INVENTION

It is an object of the invention to provide a process which is of the kind described first hereinbefore and which serves to control the slag in a top-blowing steelmaking converter and is so improved that the presence of a desirable reactive slag will be ensured whereas that slag control will not increase the probability of an occurrence of slopping.

That object is accomplished in accordance with the invention in that the actual values of the sound levels measured at predetermined frequencies are combined to form a resultant value, the difference between said resultant value and a predetermined reference value, which is associated with a sound level and indicates that slopping is likely to occur, is determined, said difference is optionally modified in dependence on other variables which influence the probability of an occurrence of slopping, said difference or modified difference is used as an indication of the probability of an occurrence of slopping and is compared with at least one predetermined probability limit, the distance of the blowing lance and optionally also the oxygen supply rate is corrected when said difference or modified difference exceeds said probability limit, and in response to an occurrence of slopping the reference value is connected in dependence on the resultant value which is derived from the actual values of the sound levels measured when slopping occurs.

The invention is based on the recognition that the resultant values which are derived from the sound levels measured during a plurality of slopping periods will mainly lie in a certain range so that it is possible to define in that range of resultant values a center or medium value with which certain sound amplitudes at the several frequencies can be associated and which indicates that slopping is likely to occur. For this reason it is possible to derive a resultant value from the sound amplitudes measured at the selected frequencies at any desired time during the blowing operation and said resultant value can be compared with a reference value which corresponds to the median value of that range of the resultant values obtained under conditions under which slopping is likely to occur and the difference between a reference value obtained under conditions under which slopping is likely to occur and the resultant value which has been obtained will indicate the probability of an occurrence slopping at the time when the sound levels have been measured. When the thus determined probability of an occurrence of slopping exceeds a predetermined limit, the control of the distance of the blowing lance from the surface of the molten metal bath and optionally also the rate at which oxygen is supplied through the blowing lance can be decreased so that the probability of an occurrence of slopping can be decreased. Said correcting steps may be carried out in a stepped manner in dependence on different predetermined probability steps, it will be possible to correct the reference value in dependence on the actual values of the sound level measured during such slopping so that the center or the median value of the range of resultant values from which the reference value is derived will be shifted. The reference value may initially be preselected, e.g., may be assumed or determined by experiment and may then repeatedly be corrected so that a slag control can be effected with which the maintenance of a foamy reactive slag will be ensured whereas slopping will be most unlikely.

To derive a resultant value from the sound amplitudes measured at selected frequencies, the several sound amplitudes may be combined in a vector space with space axes associated with respective frequencies to determine a resultant value vector and the magnitude of the difference vector determined by said resultant value vector and by the vector associated with the reference value may be determined as an indication of the probability of an occurrence of slopping in dependence on the measured sound levels. It will be understood that the probability of an occurrence of slopping will not only depend on the sound levels measured at certain frequencies but will be influenced also by other variables, such as the distance of the blowing lance from the surface of the molten metal bath, the oxygen supply rate, the total amount of oxygen supplied until the measuring time, and the condition of the converter lining. For this reason the prediction of an occurrence of slopping can greatly be improved in that the influence of said variables on the frequency distribution of the occurrence of slopping is determined. For that purpose the probability of an occurrence of slopping in dependence on the measured sound levels may be combined in accordance with the rules of the probability calculus with the probabilities or an occurrence of slopping in dependence on other variables to determine a resultant probability, which will obviously permit a more accurate slag control.

BRIEF DESCRIPTION OF THE DRAWING

The drawing is a block diagram representing an apparatus for carrying out a process of controlling the slag in a top-blowing steelmaking converter.

DETAILED DESCRIPTION OF THE PREFERRED EMBODIMENT

The process in accordance with the invention will now be described in more detail with reference to the drawing.

In the embodiment illustrated by way of example a blowing lance 2 extends into a top-blowing steelmaking converter 1 and is fixed to a slider 3, which is vertically adjustable by an actuator 4. The blowing lance 2 communicates via a supply line 5 with an oxygen source, not shown, and extends through an offtake hood 6, which is associated with the top-blowing steel-making converter 1 and from which a sound-conducting tube 7 leads to a sound pickup 8. The sound pickup 8 can be protected from assuming excessively high temperatures by a rinsing with nitrogen, which is supplied via a nitrogen line 9. The output signal of the microphone 10 of the sound pickup 8 is divided by individual band pass filters 11, 12, 13 and 14 into signals which are associated with selected frequency bands. In an evaluating circuit 15, the amplitudes of a plurality of consecutively measured sound amplitudes are averaged to determine the sound levels of said signals and said sound levels are combined to derive from them a resultant value. This is effected in that the sound levels associated with respective frequencies or frequency bands are vectorially combined to form a sum vector in an orthogonal vector space having space axes associated with respective frequencies or frequency bands. In the evaluating circuit 15, a difference vector is determined from that sum vector and from a reference vector, which is received via an input line 16 and which will be obtained under conditions under which slopping is likely to occur in view of an assumed or experimentally determined frequency distribution of occurrences of slopping. The length of that difference vector may then be used as an indication of the probability of an occurrence of slopping in dependence on a measured sound level because the probability of the occurrence of slopping will increase as the distance between the end points of the reference and sum vectors decreases. In view of the determined or assumed frequency distribution of the occurrences of slopping the actual probability of an occurrence of slopping will depend on the magnitude of the difference vector.

For an experimental determination of a reference vector, the actual values of the sound levels measured at several frequencies during a plurality of slopping periods may be combined to determine sum vectors, the end points of which are concentrated about a centroid, which will determine the reference value or the reference vector.

The probability of an occurrence of slopping will depend not only on the sound levels measured at selected frequencies of the blowing noise measured through the slag but will be influenced also by other variables. For this reason the slag can be more accurately controlled if the distance a of the blowing lance 2 from the surface 17 of the molten metal bath and the oxygen supply rate are measured in addition to the sound levels at selected frequencies. For that purpose, a position pickup 18 is associated with the slider 3 which carries the blowing lance 2 and an oxygen flow pickup 19 is associated with the supply line 5 and arithmetic stages 20, 21 are associated with the pickup 18 and 19, respectively. Frequency distributions of the occurrence of slopping in dependence on the values measured by the pickups 18 and 19 are stored in the arithmetic stages 20 and 21 so that each of said computer stages 20 and 21 can be used to determine the probability of the occurrence of slopping in dependence on the measured values which are currently received by the computer stage. Each of the probabilities which are thus determined depends on only one variable and said probabilities can be combined in accordance with the rules of probability calculus to determine a resultant probability. This can be effected in a combining stage 22 in accordance with Bayes' method to determine the probability of an occurence of slopping in dependence on the lane spacing a, the oxygen supply rate, the total quantity of oxygen supplied until the measuring time, and the age of the converter, i.e., the condition of the converter lining. For this purpose, a further arithmetic stage 23 is provided in addition to the arithmetic stages 20 and 21 and determines the probability of an occurrence of slopping in dependence on the number of heats for which the converter has been run with its present lining.

The resultant probability which has been determined by the combining stage 22 may then be compared in a controller 24 with at least one limiting value, which is input via an input terminal 25 and determines a limit for the permissible probability of an occurrence of slopping. When the resultant probability exceeds that limit the lance distance a will be decreased in that the controller 24 controls the actuator 4 for the slider 3 and/or the oxygen supply rate will be controlled by the controller 24 via an actuator 26 for a flow control value 27 in the oxygen supply line 5.

If slopping occurs in spite of said corrections, a command circuit 28 can be operated to read the actual values of the sound levels measured during the slopping period into the evaluating circuit 15 in order to correct the reference value. As a result, a slag control involving only a low probability of an occurrence of slopping can be effected after a repeated correction of the reference value read in via the input line 16.

Because the sound levels must be measured when the sound pickup 8 is not rinsed with nitrogen, a sequence control system 29 is provided, which controls a shut-off valve via an actuator 30 so that the supply of nitrogen will be interrupted in periods in which the measured values are processed by the evaluating circuit 15.

We claim:

1. A process of controlling the operation of a top-blowing steelmaking converter which is adapted to hold a molten metal bath, comprising:

blowing oxygen through at least one lance onto said bath to generate a blowing noise on the surface of said bath and to form a slag layer on said surface;

measuring the sound levels of said blowing noise with a sound pickup means through said slag layer at a plurality of predetermined frequencies;

controlling at least one of the parameters in dependence on said sound levels, said parameters comprising distance of said lance from the surface of said bath, and the rate at which oxygen is blown through said lance;

deriving a resultant value in an evaluating circuit from the actual values of said sound levels measured at said predetermined frequencies;

determining said resultant value for conditions under which a slopping of said converter is likely to occur and is used as a reference value;

determining a difference value is said evaluating circuit in dependence on said derived resultant value and said reference value from an input line and is used as an indication of the probability of an occurrence of slopping;

determining at least one probability limit for an occurrence of slopping and comprising said limit with said difference value; and if there is the occurrence of such difference value which exceeds said probability limit, then correcting at least one of the parameters comprising said distance of said lance from said surface of said bath, and of said rate at which oxygen is blown through said at least one lance to decrease said difference value.

2. The process as set forth in claim 1, comprising correcting said distance of said lance with a vertically adjustable slider from said surface of said bath to decrease said difference value when said difference value exceeds said probability limit.

3. The process as set forth in claim 2, comprising correcting said rate at which oxygen is blown through said lance with a flow control valve to decrease said difference value when said difference value exceeds said probability limit.

4. The process as set forth in claim 1, comprising determining said difference value as the difference between said derived resultant value and said reference value .

5. The process as set forth in claim 1, comprising measuring at least one additional variable in a controller means which influences the probability of the occurrence of a slopping of said converter, and;

determining said difference value in accordance with the rules of probability calculus in dependence on the difference between said derived resultant value and said reference value and in dependence on said at least one additional variable.

6. The process as set forth in claim 5, further comprising a position pickup means for determining the distance of said blowing lance from the surface of said bath, as said at least one additional variable.

7. The process as set forth in claim 5, further comprising an oxygen flow pickup means for determining the rate at which oxygen is blown through said at least one lance, as said at least one additional variable.

8. The process as set forth in claim 5, comprising an arithmetic stage for determining the total quantity of oxygen which has been blown through said at least one lance in the current heat, as said at least one additional variable.

9. The process as set forth in claim 5, comprising a further arithmetic stage for determining the number of heats for which said converter has been run without relining, as said at least one additional variable.

10. The process as set forth in claim 1, comprising determining said reference value as said resultant value derived from said sound levels measured when said converter is actually slopping.

* * * * *